US010833412B2

(12) United States Patent
Lindenmeier et al.

(10) Patent No.: US 10,833,412 B2
(45) Date of Patent: Nov. 10, 2020

(54) ANTENNA ARRANGEMENT FOR CIRCULARLY POLARIZED SATELLITE RADIO SIGNALS ON A VEHICLE

(71) Applicant: FUBA AUTOMOTIVE ELECTRONICS GMBH, Bad Salzdelfurth (DE)

(72) Inventors: Stefan Lindenmeier, Gauting-Buchendorf (DE); Heinz Lindenmeier, Planegg (DE)

(73) Assignee: FUBA Automotive Electronics GmbH (DE)

( * ) Notice: Subject to any disclaimer, the term of this patent is extended or adjusted under 35 U.S.C. 154(b) by 0 days.

(21) Appl. No.: 16/164,563

(22) Filed: Oct. 18, 2018

(65) Prior Publication Data

US 2019/0260129 A1 Aug. 22, 2019

(30) Foreign Application Priority Data

Oct. 19, 2017 (DE) ..... 10 2017 009 758

(51) Int. Cl.

| | |
|---|---|
| ***H01Q 1/32*** | (2006.01) |
| ***H01Q 9/04*** | (2006.01) |
| ***H01Q 15/14*** | (2006.01) |
| ***H01Q 19/00*** | (2006.01) |

(Continued)

(52) U.S. Cl.

CPC ..... *H01Q 9/0407* (2013.01); *H01Q 1/3275* (2013.01); *H01Q 15/147* (2013.01); *H01Q 19/005* (2013.01); *H01Q 19/28* (2013.01); *H01Q 21/26* (2013.01); *H01Q 9/0435* (2013.01)

(58) Field of Classification Search

CPC .. H01Q 9/0407; H01Q 1/3275; H01Q 15/147; H01Q 19/005; H01Q 19/28; H01Q 21/26; H01Q 9/0435

See application file for complete search history.

(56) References Cited

U.S. PATENT DOCUMENTS

2010/0141517 A1* 6/2010 Surittikul ..... H01Q 3/446 342/357.64

2013/0050037 A1 2/2013 Takemura et al.

FOREIGN PATENT DOCUMENTS

DE 4008505 A1 9/1991
DE 10163793 A1 9/2002

(Continued)

OTHER PUBLICATIONS

Extended EP Search Report for related EP Application No. 18201246.8; dated: Mar. 14, 2019; 8 pages.

*Primary Examiner* — Dieu Hien T Duong
(74) *Attorney, Agent, or Firm* — Dickinson Wright PLLC

(57) ABSTRACT

An antenna arrangement for the reception of circularly polarized satellite radio signals having a free space wavelength λ and a frequency f comprises at least one circularly polarized satellite reception antenna positioned above an electrically conductive base surface whose outline is inscribed by a circle K about its phase center PZ having a relative antenna radius ra/λ<0.15. A director is present that comprises a horizontal electrical conductor that has two conductor ends and that is guided over a director length Ld at a director height hd above the conductive base surface. The horizontal electrical conductor is angled at its two conductor ends and extends from there as vertical conductor in each case toward the conductive base surface.

19 Claims, 16 Drawing Sheets

Figure 1A:
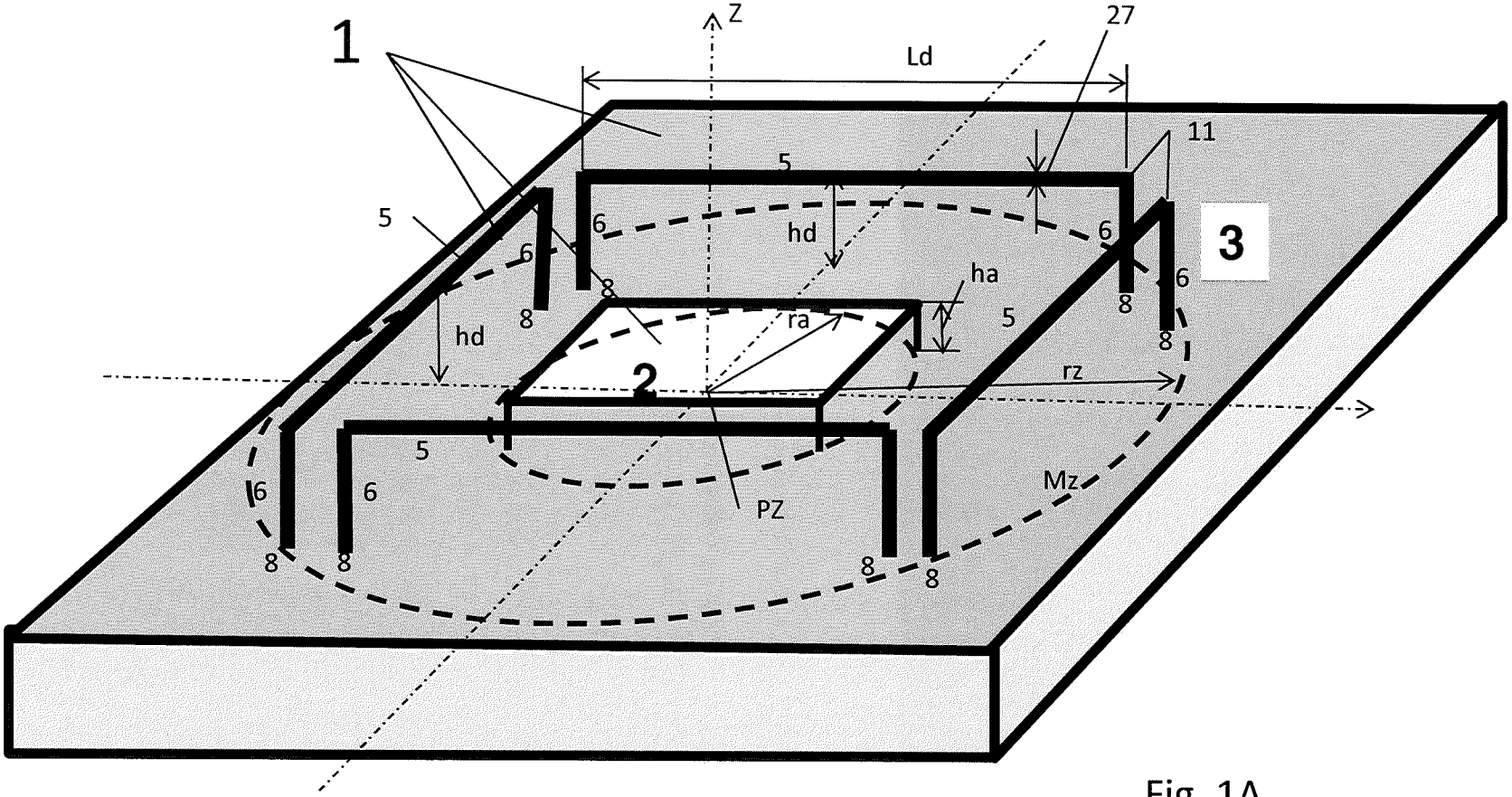

(51) Int. Cl.
*H01Q 19/28* (2006.01)
*H01Q 21/26* (2006.01)

(56) References Cited

FOREIGN PATENT DOCUMENTS

| | | | |
|---|---|---|---|
| EP | 0340404 | A2 | 11/1989 |
| WO | 2008054803 | A2 | 5/2008 |

* cited by examiner

ANTENNA ARRANGEMENT FOR CIRCULARLY POLARIZED SATELLITE RADIO SIGNALS ON A VEHICLE

CROSS-REFERENCES TO RELATED APPLICATIONS

This application claims the priority of German Application No. 102017009758.5 filed on Oct. 19, 2017, which is incorporated herein by reference, in its entirety.

The invention relates to an antenna arrangement for the reception of circularly polarized satellite radio signals, in particular for satellite radio navigation.

In particular with satellite navigation systems, the profitability and also the efficiency of the reception antenna with respect to the transmission power irradiated by the satellite are particularly important. Satellite radio signals are as a rule transmitted using circularly polarized electromagnetic waves due to polarization rotation on the transmission path and are used for all known satellite navigation systems. Modern navigation systems provide for an evaluation of the simultaneously received radio signals of a plurality of satellite navigation systems, in particular for global availability in conjunction with high navigation accuracy in mobile navigation. Such systems that receive in combination are collected together under the name GNSS (global navigation satellite system) and include known systems such as GPS, GLONASS, Galileo and Beidou, etc. Satellite antennas for navigation on vehicles are as a rule set up on the electrically conductive outer skin of the vehicle body. Circularly polarized satellite reception antennas are used such as are known from the documents DE-A-10 2009 040 910, DE-A-40 08 505 and DE-A-101 63 793. In particular those antennas that are characterized by a low construction height in conjunction with a cost-effective manufacturing capability are suitable for setup on vehicles. This particularly includes, for example, the circular, polygonal, or quadratic loop antenna that is known from document DE-A-10-2009 040 910, that is designed as a resonant structure, that has a small construction volume, and that is in particular absolutely necessary for mobile applications. The antenna has a required conductive base area of a comparatively small size and is very low with a height of less than one tenth of the free space wavelength. Patch antennas that are, however, less powerful with respect to reception at a low angle of elevation are known from the prior art as further antennas for satellite navigation on vehicles. One challenge for the satellite antennas for GNSS comprises the demand for a large frequency bandwidth that is, for example, predefined by the frequency band L1 having the center frequency 1575 MHz (required bandwidth approximately 80 Hz) for GPS and by the frequency band L2 having the center frequency 1227 MHz (required bandwidth approximately 53 MHz). This demand is, for example, covered by separate antennas that are each associated with one of the two frequency bands L1 or L2 or by an antenna covering both frequency bands. Systems for the simultaneous evaluation of signal content in the frequency bands L1 and L2 make particularly high demands on the properties of the antennas, in particular due to the small available construction space such as is above all always present in vehicle construction. The use of separate antennas located in close proximity with one another for the two frequency bands includes the problem of mutual electromagnetic coupling with the effect of influencing the directional patterns and the polarization unit, and in particular the cross polarization in areas of low angles of elevation. Due to the signals of the locating satellites incident at low angles of elevation, the suppression of the opposite polarization direction—the cross-polarization (LHCP)—becomes particularly important with respect to exact location results in the desired—typically right handed circular (RHCP) polarization direction. The accuracy of the position location result is thus particularly dependent on the ratio of the desired polarization to the cross polarization of the satellite reception antenna—that is on its cross-polarization spacing.

On the other hand, the implementation of a satellite navigation antenna is technically difficult that with a center frequency of approximately 1385 MHz covers both frequency bands with a bandwidth of approximately 360 MHz and additionally satisfies the in part strict demands on the cross-polarization spacing and on the antenna gain in areas of low angles of elevation.

As already mentioned, in particular satellite reception antennas having a small construction space are suitable for use on vehicles. Antennas of this kind in accordance with the prior art are known as patch antennas. They are, however, less powerful with respect to reception at low angles of elevation. This disadvantage is remedied in part by loop antennas such as are described in DE 10 2009 040 910 A. It is, however, also desirable for such antennas in particular to improve the cross-polarization spacing in the area of low angles of elevation.

A demand on the design of the antenna system specific to the use on vehicles also results in many cases from the restriction of the available construction space that is frequently characterized by an azimuthally asymmetrical environment of the satellite navigation antenna. Satellite antennas are as a rule set up on horizontal surfaces of the electrically conductive outer skin of a vehicle. The direct proximity to the upper margin of the cut-out of the rear window pane—that is the rear roof edge—is frequently specified, for example, as an attachment location of such a satellite reception antenna on the electrically conductive vehicle roof that is preferred from a technical vehicle aspect. In many cases, the vehicle roof is curved toward the window margin and is designed in a sloping manner so that the satellite antenna is not set up on an azimuthally planar and completely horizontal conductive base surface. This also has a negative effect both on the azimuthal omnidirectional pattern and to a particular degree also on the azimuthally dependent direction, on the cross-polarization spacing, and on the gain, in particular at low angles of elevation. This disruption of the reception properties of the satellite antenna always results in those cases in which the antenna is set up in part in the proximity of the marginal region of the horizontal car body surface.

It is the object of the invention to provide an antenna arrangement having a small construction height on a vehicle for circularly polarized satellite radio signals, said antenna arrangement having a high cross-polarization spacing with sufficient gain at low angles of elevation of the radiation characteristics.

This object is satisfied by the features of claim 1.

In accordance with the invention, an antenna arrangement (1) for the reception of circularly polarized satellite radio signals having a free space wavelength $\lambda$ and a frequency f comprises at least one circularly polarized satellite reception antenna (2) positioned above an electrically conductive base surface (3), in particular for satellite navigation with a relative antenna height $ha/\lambda<0.15$ whose outline is inscribed by a circle K about its phase center PZ having a relative antenna radius $ra/\lambda<0.15$. A director (4) is furthermore present that comprises a horizontal electrical conductor (5) that has two conductor ends (11) that is guided over a director length Ld at a director height hd above the conductive base surface (3), and indeed at least approximated to a jacket surface Mz of a cylinder oriented perpendicular to the conductive base surface and having a cylinder radius rz and a central axis Z through the phase center PZ of the satellite reception antenna (2), wherein the horizontal electrical conductor (5) is angled at its two conductor ends (11) and extends from there as a vertical conductor (6) in each case toward the conductive base surface (3) and is electrically conductively connected thereto. The director (4) can be adapted by designing the director length Ld, the director height hd, and the vertical conductors (6) in a manner such that its natural resonant frequency is set in frequency proximity to the frequency f.

Advantageous embodiments can be designed as follows:

It is possible that the relative director length is selected in the range $0.2<Ld/\lambda<0.4$ the relative director height is selected in the range $0.03<hd/\lambda<0.15$ the relative cylinder radius is selected in the range $0.15<rz/\lambda<0.5$.

It is possible that the elongated horizontal electrical conductor 5 is either curved or is designed secant-like in a straight line in a plan view in approximation to the curved jacket surface Mz of the cylinder.

It is possible that the director length Ld is selected a little shorter than the resonant length, that is a little below 90% of half the free space wavelength λ, and that the cylinder radius rz is selected at approximately 20% of the free space wavelength λ.

It is possible that in order to reduce the cross-polarization at small angles of elevation over the total azimuth angle range, at least three directors 4 are arranged azimuthally uniformly about the satellite reception antenna 2 and the cylinder radius rz is selected as no more than half a free space wavelength.

It is possible that, in order to compensate an impairment of the azimuthal directional pattern and of the cross-polarization spacing caused by an azimuthally sectorally irregular environment, in particular with angles of elevation around 30°, the at least one director 4 is positioned azimuthally accordingly at a spacing of no more than half a free space frequency wavelength λ remote from the phase center PZ for a direct irregular change of the horizontal directionality.

It is possible that an electrically conductive ground plate 3*a* lying on the electrically conductive outer skin of the vehicle is present as a mechanical carrier of the satellite reception antenna 2 and of the at least one director 4 on which ground plate 3*a* the ground points for the electrically effective connection of the director 4 to the conductive base surface 3 are formed.

It is possible that the director 4 is configured in wire form.

It is possible that the ground plate 3*a* is designed at least in part from an electrically conductive sheet metal surface and that the director 4 is cut out of this sheet metal surface except for a connection web 26 as a ground point 8 and is bent out of the sheet metal surface by the bend angle 10.

It is possible that for the azimuthally sectoral raising of the antenna gain for small angles of elevation at least two directors 4 are arranged closely adjacent to one another along the cylinder jacket Mz and that the mutually adjacent conductor ends 11 of the elongated horizontal electrical conductors 5 are capacitively coupled to one another.

It is possible that for the azimuthally independent raising of the antenna gain and for a further improvement of the cross-polarization spacing, the satellite reception antenna 2 is completely surrounded in an azimuthally symmetrical form by mutually adjacent directors 4 that are capacitively coupled to one another with respect to their conductor ends 11.

It is possible that the directors 4 comprise electrically conductive sheet metal and are respectively shaped and bent in angled form at the conductor ends 11 of the elongated electrical conductor 5 in a manner such that a respective sheet metal lug 12 is formed and such that the capacitive coupling is effected by the lug surfaces of the respective mutually adjacent directors 4 in parallel with one another.

It is possible that the directors 4 arranged in ring form are assembled in a contiguous manner to form a mechanically coherent ring of sheet metal, with the connection of the directors 4 to one another being given by connection webs 26 that are in particular short, that are placed on the ground plate 3*a*, and that are connected by it electrically conductively to the ground points 8.

It is possible that the satellite reception antenna 2 comprises a circularly polarized loop antenna 13 having a relative height $ha/\lambda\sim0.1$ and its vertical projection is inscribed by a circle having the relative antenna radius $ra/\lambda\sim0.13$ nm about its phase center PZ; and the relative director length $Ld/\lambda\sim0.3$ is selected; and the relative director height $hd/\lambda\sim0.07$ is selected; and the relative cylinder radius $rz/\lambda\sim0.2$ is selected.

It is possible that the satellite antenna reception antenna 2 is formed as a circularly polarized patch antenna 14.

The advantage is associated with an antenna arrangement 1 in accordance with the invention that on a use of a predefined satellite reception antenna 2 that is suitable for the reception of the location satellites, but is not specified in any more detail, the radiation properties can be directly improved by the design and placement in accordance with the invention of the directors 4 with respect to gain and cross-polarization suppression.

A particular advantage of the invention also comprises the fact that it makes it possible with an azimuthally irregular environment of the antenna arrangement 1 to eliminate the disruption of its omnidirectional radiation characteristics thereby caused with respect to gain and cross-polarization spacing.

A further advantage of an antenna arrangement 1 in accordance with the invention is the particularly simple manufacturing capability and attachment capability of the directors 4 that also enables the implementation by simple bent sheet metal structures or wire structures.

In accordance with the invention, an antenna arrangement 1 for the reception of circularly polarized satellite radio signals of the free space wavelength λ having at least one circularly polarized satellite reception antenna 2 having a phase center PZ arranged above a substantially horizontally oriented outer skin of a vehicle 7 that serves as an electrically conductive base surface 3. It has a relative antenna height $ha/\lambda<0.15$ and is inscribed with its vertical projection by a circle K having the relative antenna radius $ra/\lambda<0.15$ about its phase center PZ. At least one director 4 is present that is formed from a substantially elongated horizontal electrical conductor 5 and that is led over the director length Ld below the director height hd above the conductive base surface 3 approximately along the jacket surface of a perpendicularly oriented cylinder having a cylinder radius rz and a central axis Z through the phase center PZ of the satellite antenna 2. The horizontal electrical conductor 5 is kinked at both ends of the length L and extends as a vertical conductor 6 respectively toward the conductive base surface 3 and is conductively connected thereto. The relative director length Ld is selected in the range $0.2<Ld/\lambda<0.4$. The relative director height hd is selected in the range $0.03\ hd/\lambda<0.15$. The relative cylinder radius is selected in the range $0.15<rz/\lambda<0.4$.

Figure 1B:
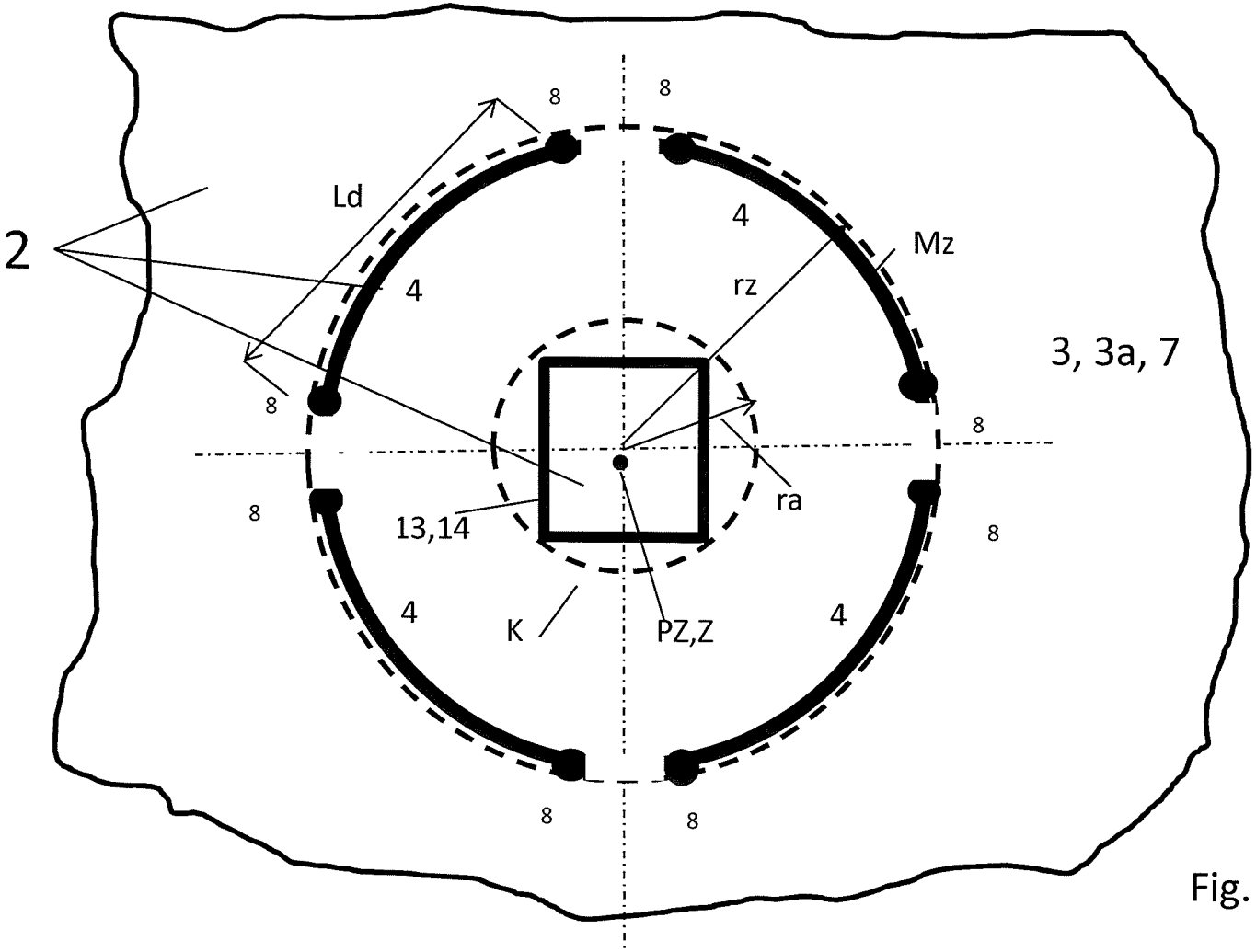
Figure 3B:
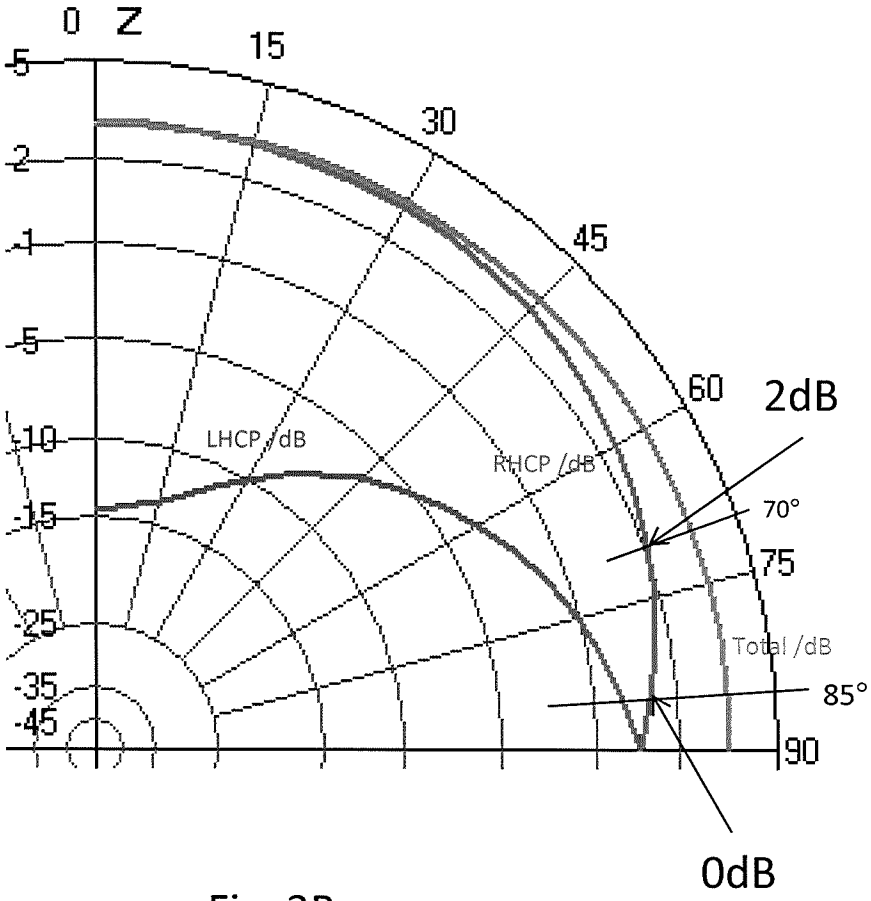
Figure 3A:
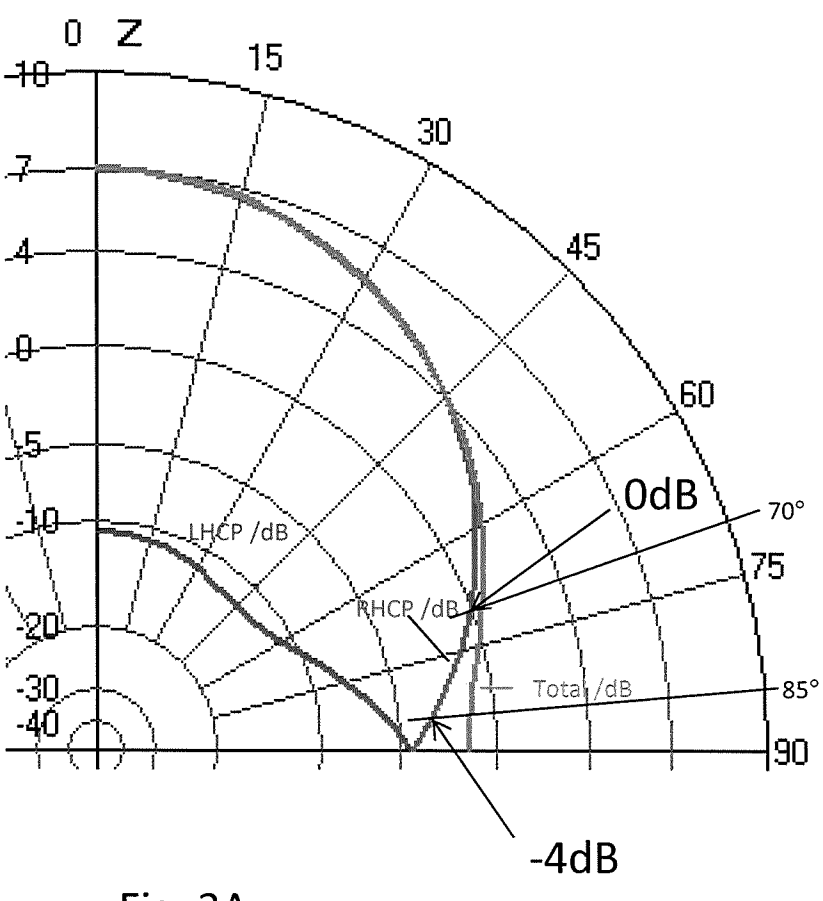

The invention will be explained in more detail in the following with reference to embodiments. The associated Figures show in detail:

FIG. 1A:

a spatial representation of an antenna arrangement 1 in accordance with the invention having an electrically small satellite reception antenna 2 having a phase center PZ at the center Z on the outer skin of a vehicle 7 as an electrically conductive base surface 3, azimuthally surrounded by directors 4 in accordance with the invention. They respectively comprise by way of example a straight-line horizontal electrical conductor 5 of the length Ld that is led below a height hd and that continues at its two ends in each case with a vertical conductor 6 leading toward the conductive base surface 3 and whose lower end is conductively connected to the conductive base surface 3 via a ground point 8. The horizontal conductors 5 are led in a straight line approximately along the jacket surface Mz of a perpendicularly oriented cylinder having a cylinder radius rz. The electrically small satellite reception antenna 2 is inscribed by a construction space of a height ha and by the circle K having the antenna radius ra about its center Z;

FIG. 1B a plan view of an antenna arrangement 1 in accordance with the invention as in FIG. 1A for representing the arrangement of the directors 4 curved in a plan view having a respective horizontal conductor 5 extending in a curved manner along the jacket surface Mz below the height hd as a segment of a circular level curve of the jacket surface Mz of the perpendicularly oriented cylinder having the cylinder radius rz;

FIG. 2:

a plan view of an antenna arrangement 1 in accordance with the invention as in FIG. 1A for representing the arrangement of the directors 4 having a respective horizontal conductor 5 extending in a straight line below the height hd substantially as a secant of a circular level curve of the jacket surface Mz of the perpendicularly oriented cylinder having the cylinder radius rz;

FIGS. 3A and 3B:

a comparison of the vertical directional pattern in FIG. 3A of a satellite reception antenna 2 and of the vertical directional pattern in FIG. 3B of the same satellite reception antenna 2 in an antenna arrangement 1 in accordance with the invention in each case for the desired circular polarization direction RHCP and the cross-polarization direction LHCP in each case with a marking of the direction of incidence at the angle of elevation of 20° (zenith angle 70°) and the angle of elevation of 5° (zenith angle 85°).

Figure 4B:
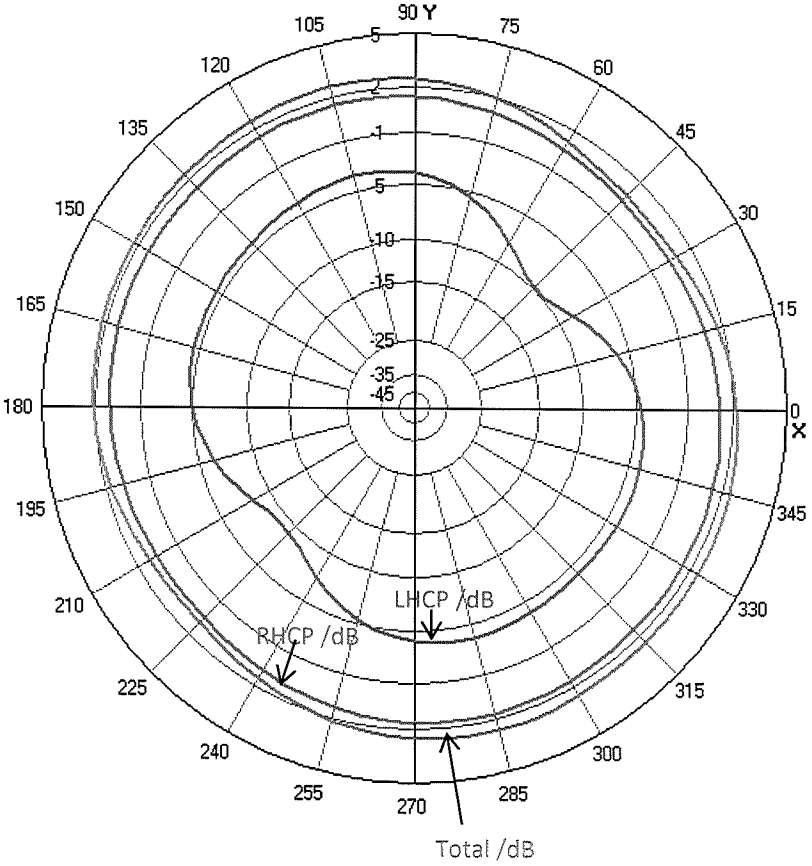
Figure 4A:
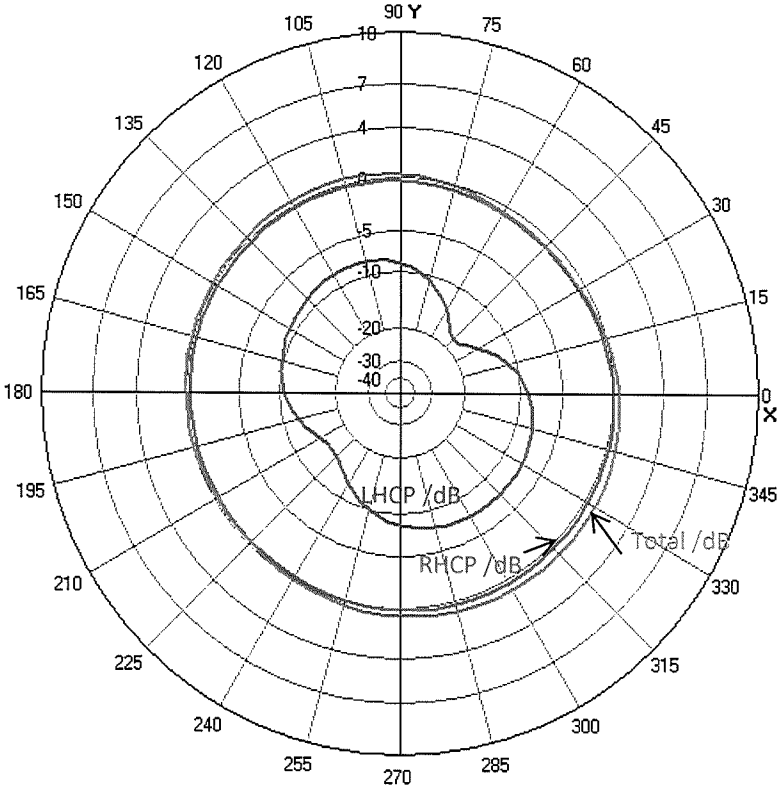
Figure 5B:
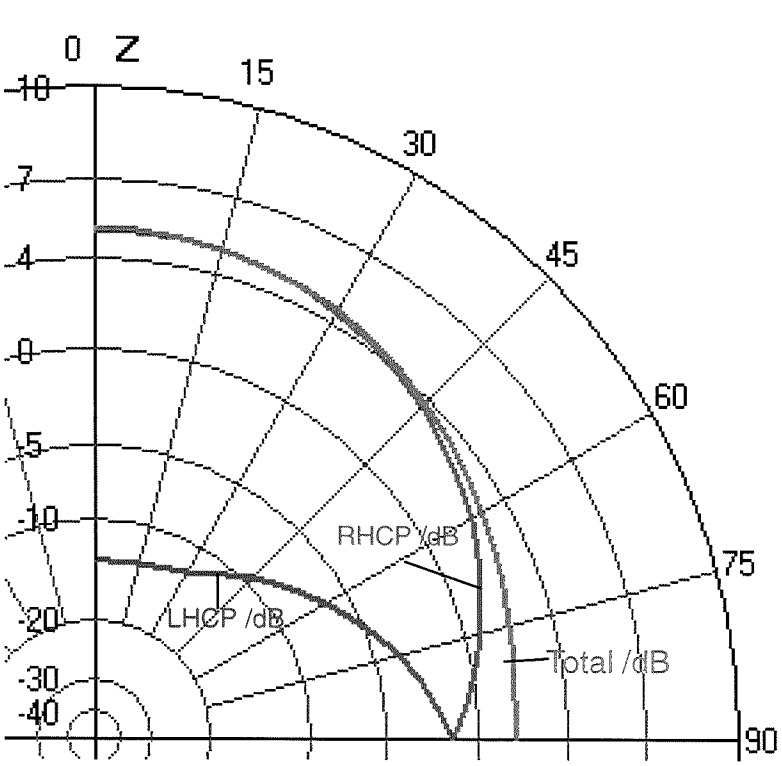
Figure 5A:
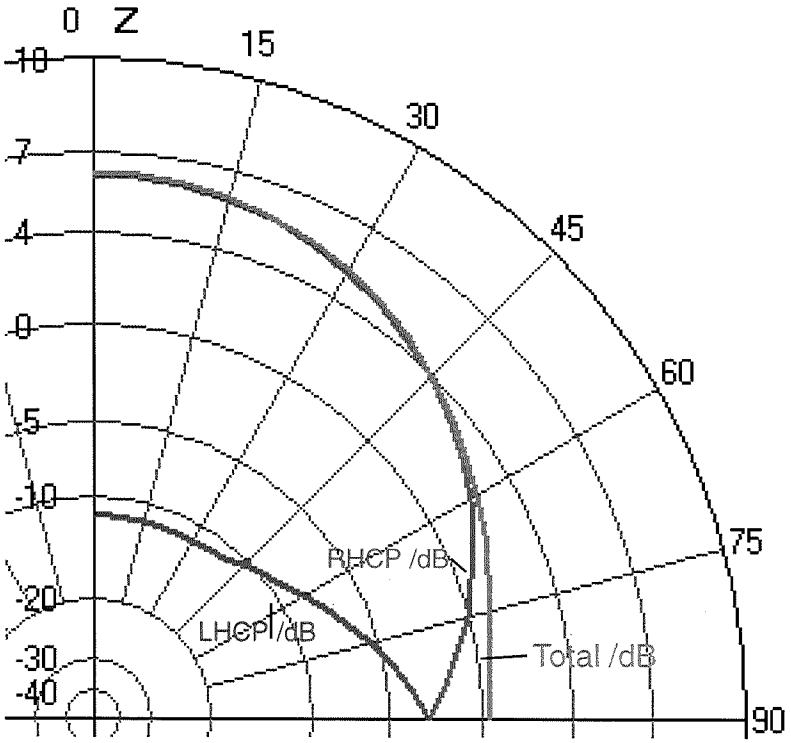

There results with a band center in the band L1 (f=1.565 Mz):

antenna gain at angle of elevation 20°, RCHP case a) 0 dB; case b) 2 dB antenna gain at angle of elevation 20°; LCHP case a) −8 dB, case b) −1.5 dB antenna gain at angle of elevation 5°; RCHP case a) −4 dB; case b) 0 dB antenna gain at angle of elevation 5°; LCHP case a) −5.2 dB; case b) −0.5 dB Result: the RHCP antenna gain of the antenna arrangement 1 in accordance with the invention exceeds the antenna gain of the single antenna by 4 dB at an angle of elevation of 5° and by approximately 2 dB at an angle of elevation of 20°;

FIGS. 4A and 4B:

a comparison of the azimuthal diagrams in correlation with the vertical directional patterns in FIGS. 3A and 3B at the frequency band center of L1 (f=1.565 MHz). Angle of elevation=20°, and specifically, FIG. 4A, a satellite reception antenna 2 and FIG. 4B, an antenna arrangement 1 in accordance with the invention. Result: a considerable increase by approximately 2 dB is achieved using the antenna arrangement 1 in accordance with the invention at an angle of elevation of 20°;

FIGS. 5A and 5B:

a comparison of the vertical directional patterns as in FIGS. 3A and 3B, but at band center in the band L2 (f=1.225 MHz):

FIG. 5A, a satellite reception antenna 2 and FIG. 5B, an antenna arrangement 1 in accordance with the invention.

Figure 6B:
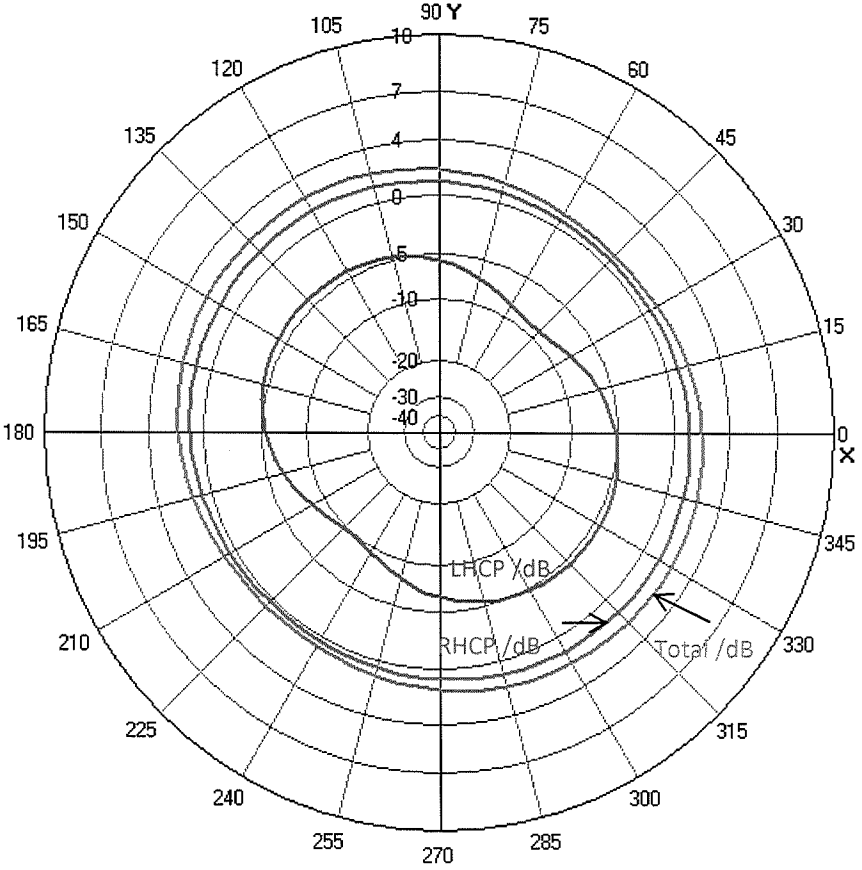
Figure 6A:
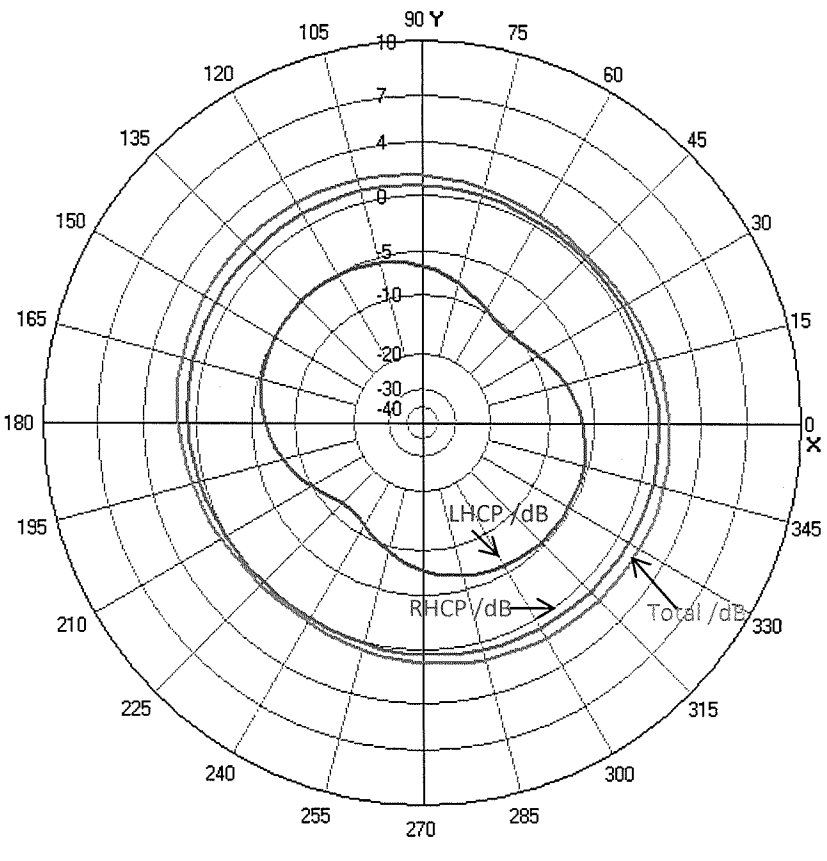
Figure 7B:
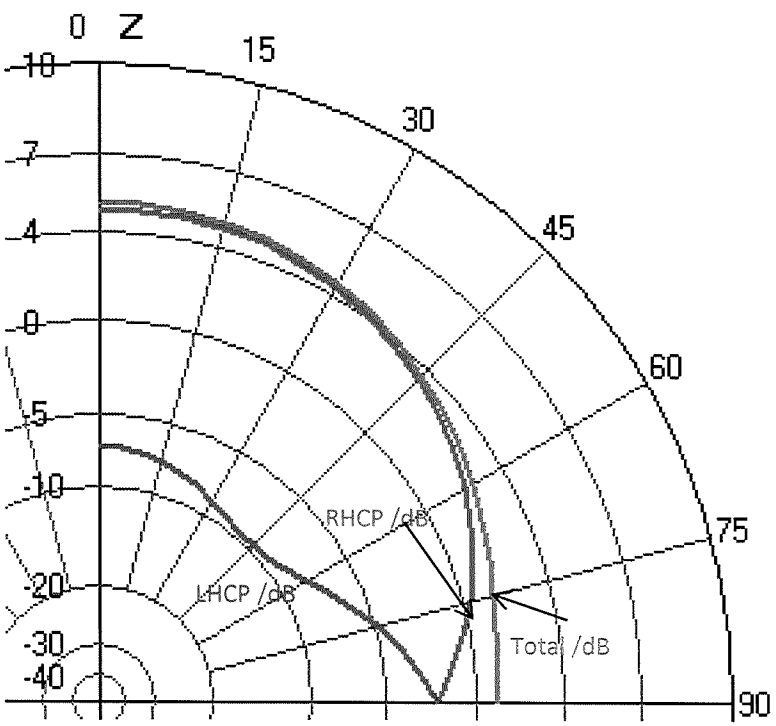
Figure 7A:
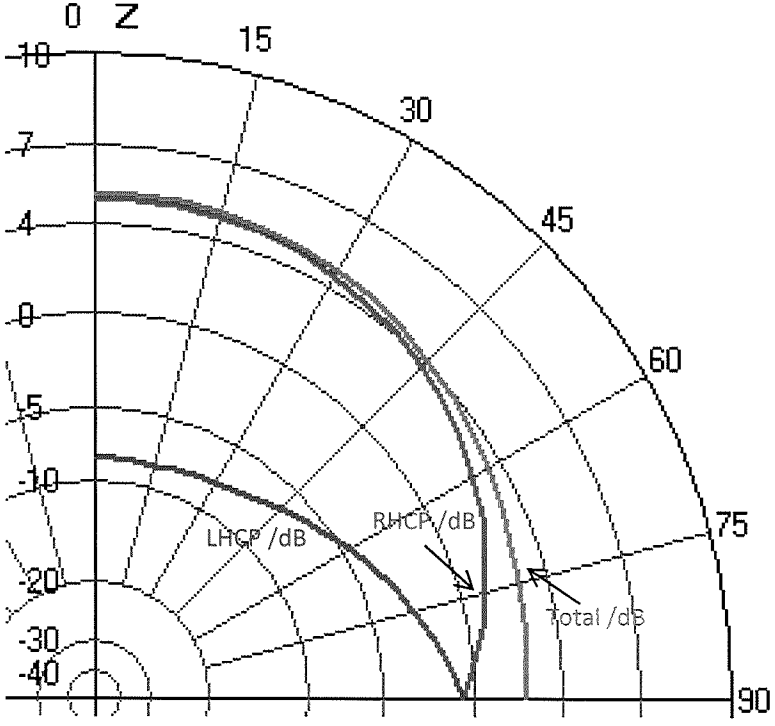
Figure 9:
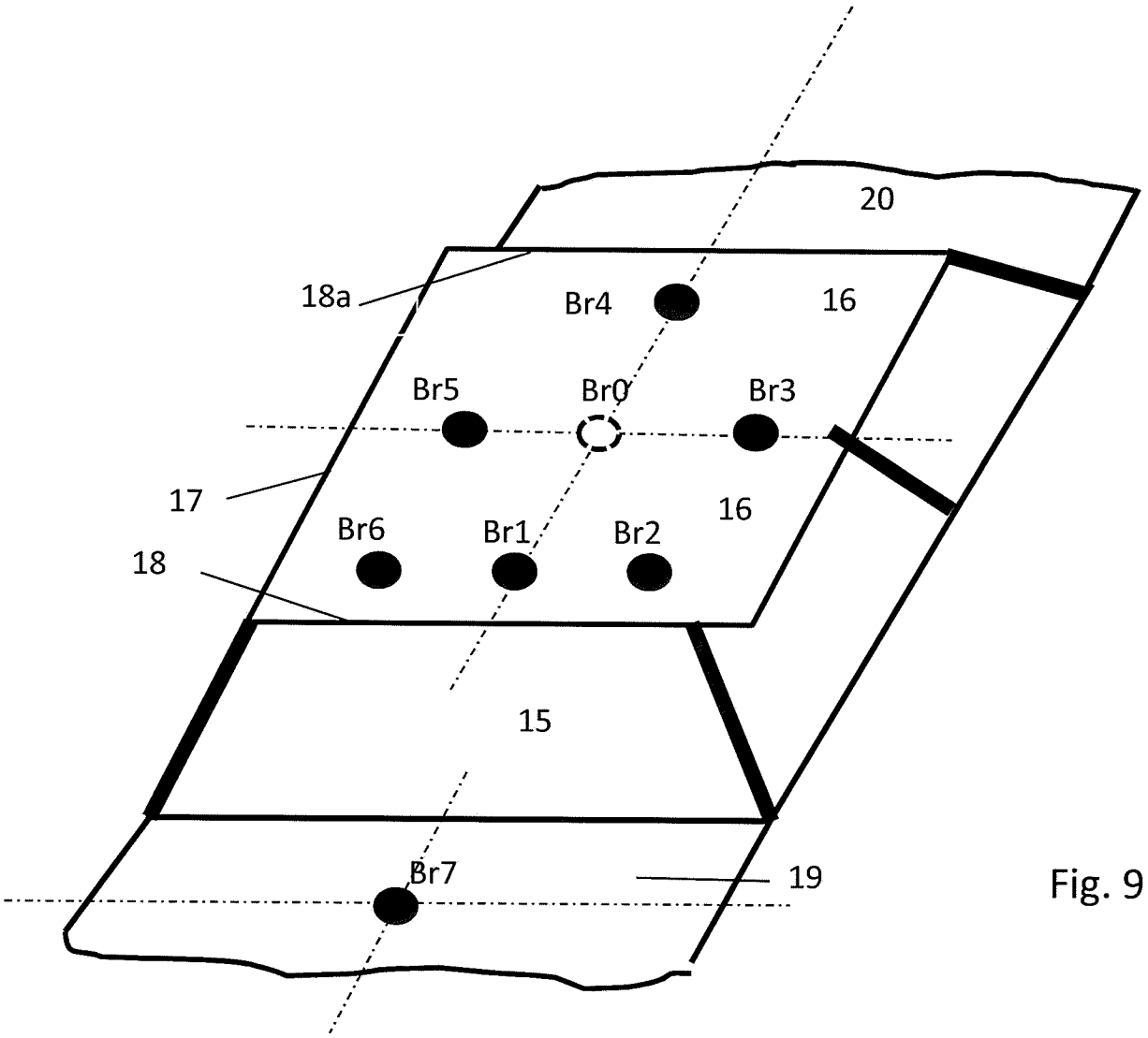
Figure 10:
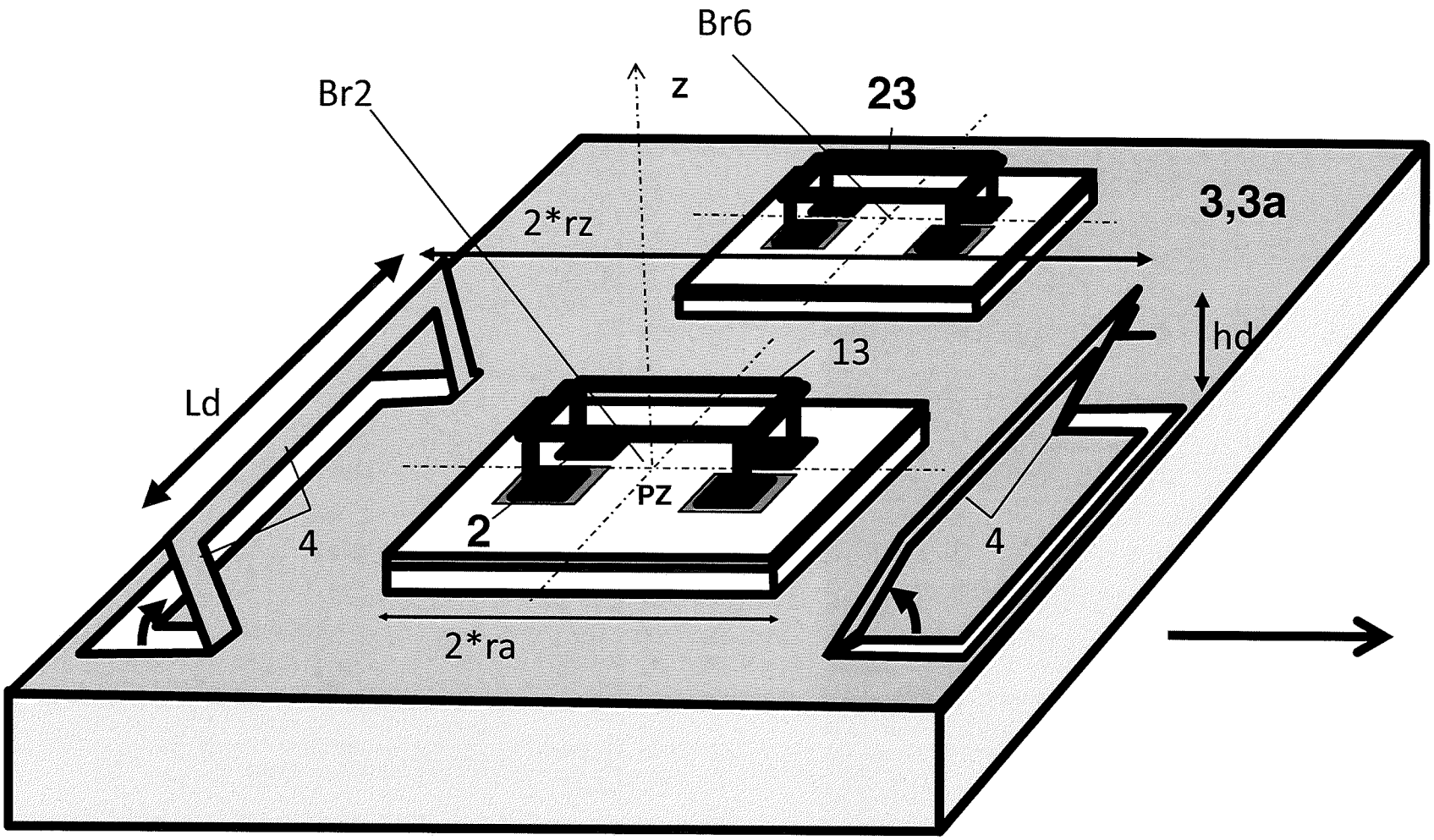
Figure 12:
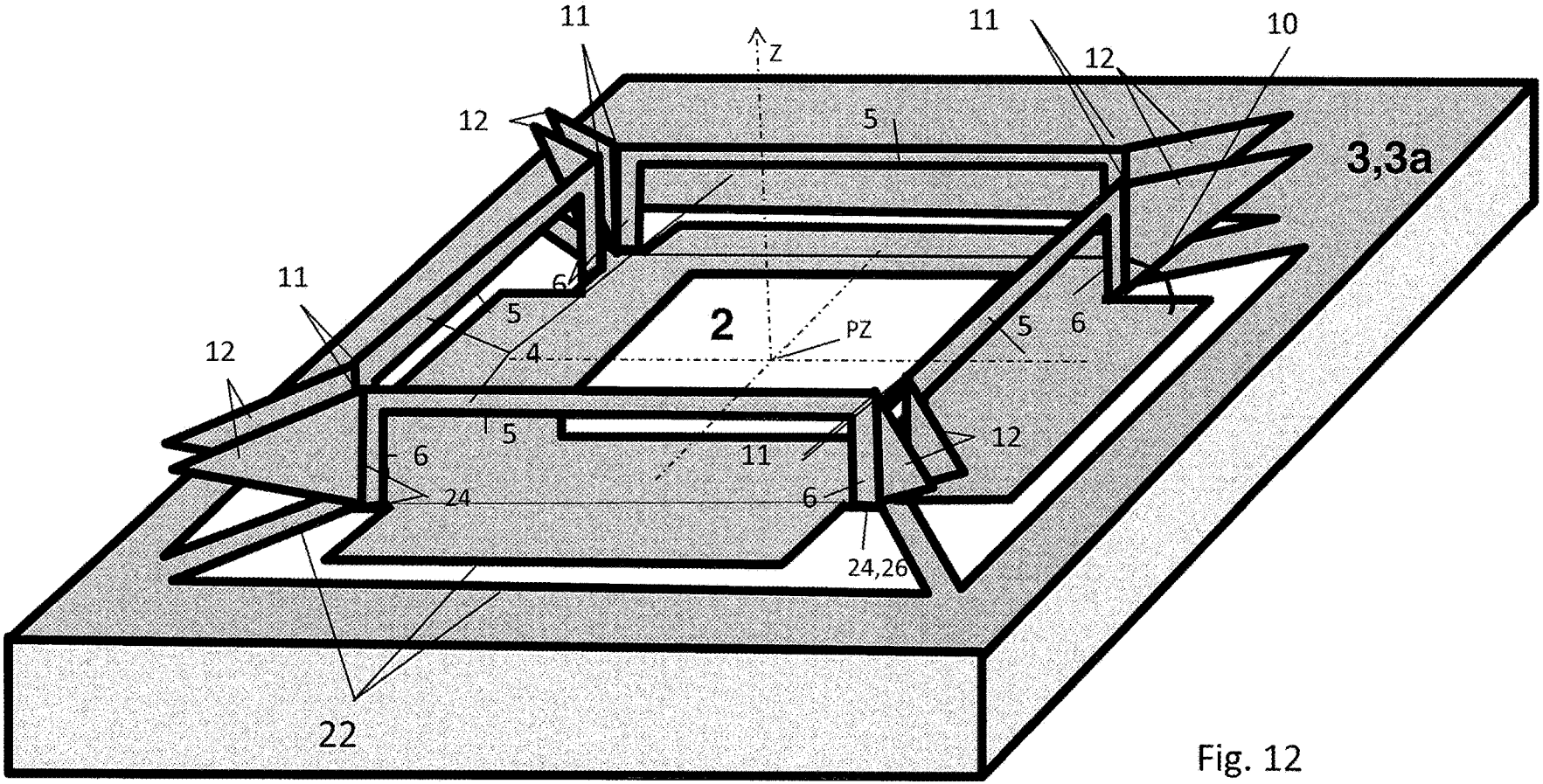
Figure 13:
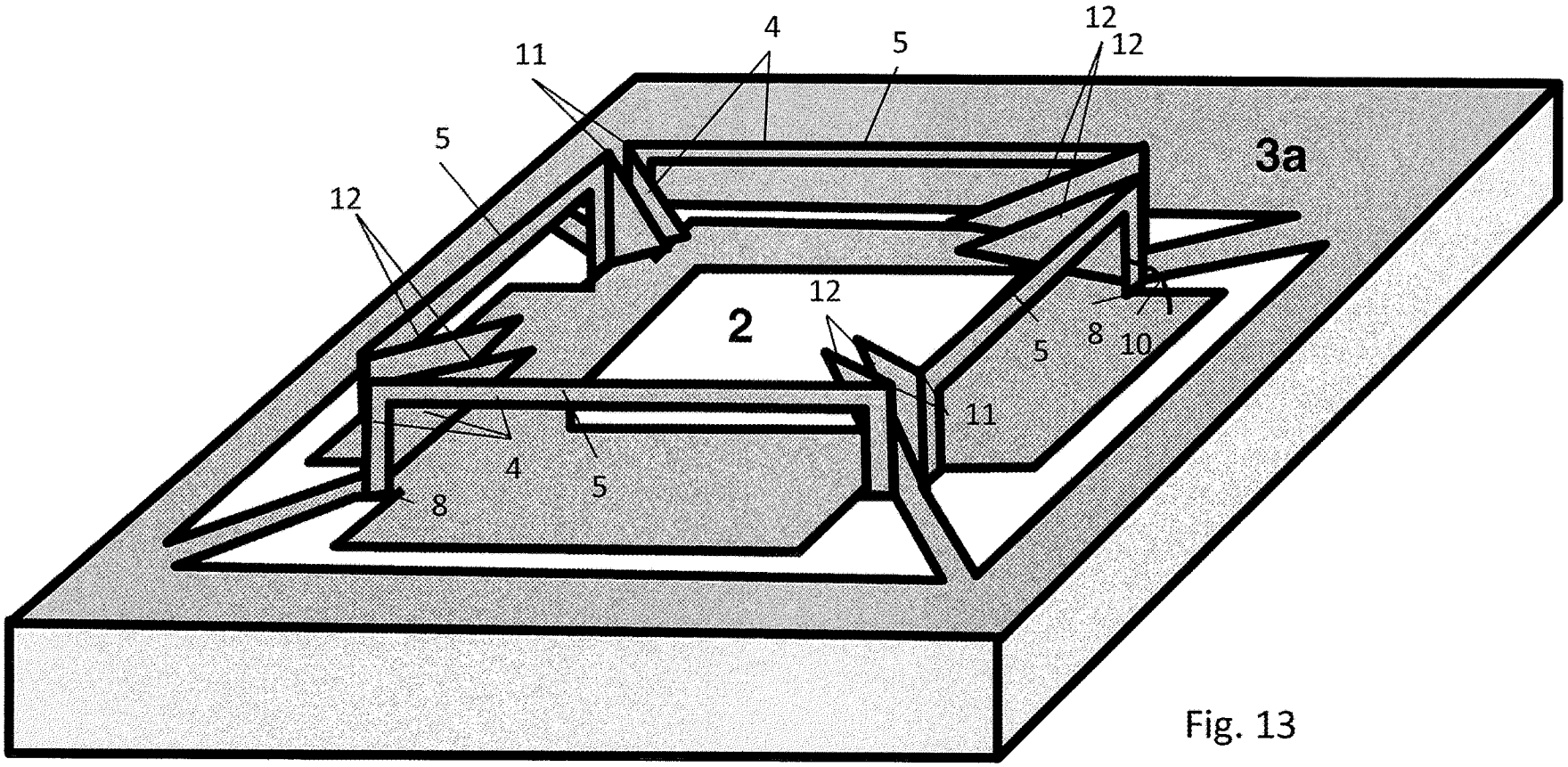
Figure 14A:
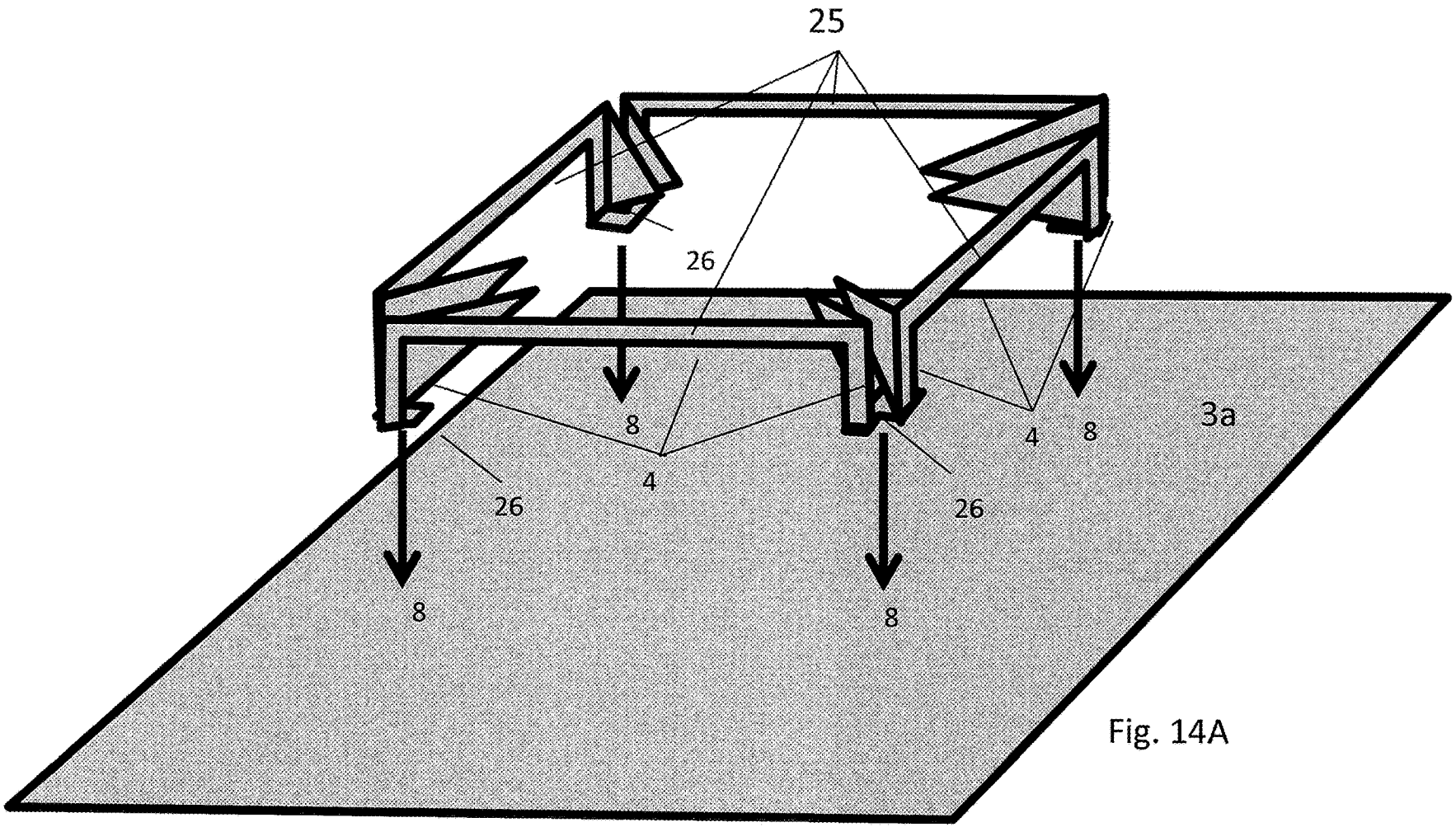
Figure 14B:
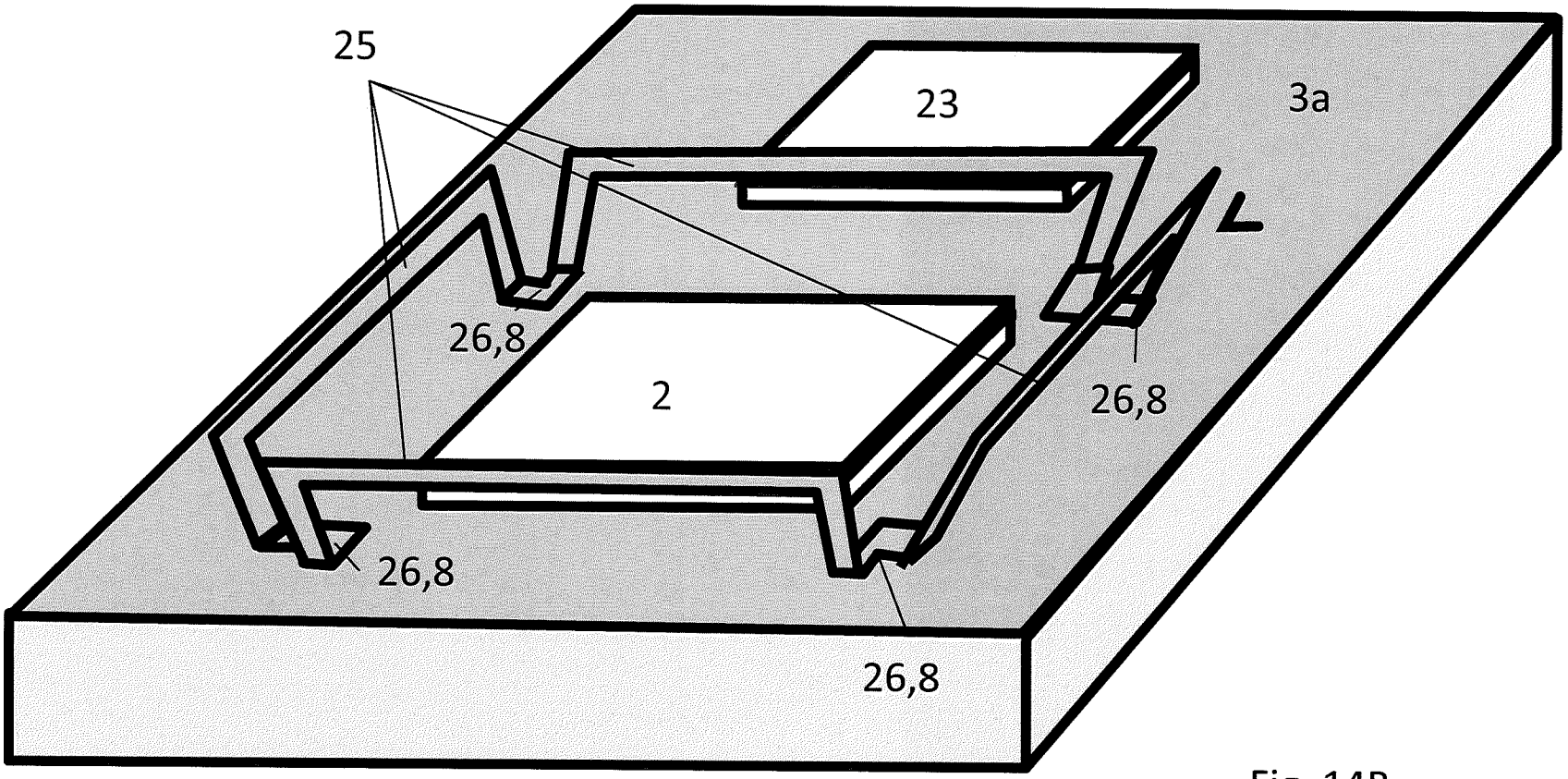

Result: the RHCP antenna gain of the antenna arrangement 1 in accordance with the invention exceeds the antenna gain of the single antenna by 1.5 dB at an angle of elevation of 5° and by approximately 0.7 dB at an angle of elevation of 20°;

FIGS. 6A and 6B:

a comparison of the azimuthal patterns as in FIGS. 5A and 5B, at band center in the band L2 (f=1.225 MHz), and specifically FIG. 6A, a satellite reception antenna 2 and FIG. 6B, an antenna arrangement 1 in accordance with the invention. Result: a considerable increase by approximately 0.7 dB is achieved using the antenna arrangement 1 in accordance with the invention at an angle of elevation of 20°;

FIGS. 7A and 7B:

a vertical directional patterns of the antenna arrangement 1 in accordance with the invention at the frequency band boundaries of the frequency band L2, with FIG. 7A, at the lower frequency band boundary (f=1200; MHz);

and FIG. 7B, at the upper frequency band boundary (f=1250 MHz) of the navigation frequency band L2;

FIG. 8:

a spatial representation of an antenna arrangement 1 in accordance with the invention as in FIG. 1A, but with directors 4 comprising electrically conductive sheet metal. The ground plate 3*a* lying on the outer skin of the vehicle as a mechanical carrier of the satellite reception antenna 2 and of the directors 4 is shown as a sheet metal surface 3*a* in the example. The directors 4 are cut out and are bent out of the sheet metal surface 3*a* by the bend angle 10 from this sheet metal surface except for a connection web 26 forming the ground connection as a center of rotation—that also acts as a ground point 8;

FIG. 9:

a representation of the construction spaces Br1-Br7 preferred from a technical vehicle aspect for satellite reception antennas 2 on the electrically conductive outer skin of a motor vehicle 7. The location at the center of the vehicle roof 16 marked as Br0 is to be preferred from a technical antenna aspect but can generally be precluded from a technical vehicle aspect. The construction spaces Br1-Br6 accepted from a technical vehicle aspect are all located in the marginal region of the vehicle roof 17 with the known disadvantageous influences of the lateral rood edge 17, of the front roof edge 18*a*, and of the rear roof edge 18 with respect to the radiation pattern of satellite reception antennas 2 having omnidirectional characteristics. Construction spaces on the rear cover 19, for example Br7, are also less suitable due to the effect of the upper vehicle structure shading the radiation;

FIG. 10:

an attachment of the antenna arrangement 1 in accordance with the invention having the indicated dimensions for GNSS applications, for example at construction space Br2 in FIG. 9. The effect of the rear roof edge 18 restricting the omnidirectionality and of the curvature of the vehicle roof 16 with the aid of the directors 4 extending substantially in parallel with the rear roof edge 18 is substantially alleviated in accordance with the invention by raising the antenna gain in the direction of travel for small angles of elevation of radiation. A satellite reception antenna 23 laterally attached to the construction space Br6, for example, for the reception of satellite radio signals at the frequency of approximately 2.3 GHz is in a very advantageous manner practically not impaired with respect to its radiation properties by the antenna arrangement 1 in accordance with the invention The arrow facing to the right marks the direction of travel;

FIG. 11:

an attachment of the satellite reception antenna 2 to the construction space Br2 and of the reception antenna 23 to the construction space Br6 as in FIG. 10, but with directors 4 arranged all around azimuthally for raising the antenna gain for omnidirectionality at small angles of elevation. The radiation properties of the satellite reception antennas 23 are practically not impaired by the presence of the antenna arrangement in accordance with the invention with a suitable choice of the director height hd and of the bend angle 10;

FIG. 12:

an antenna arrangement 1 in accordance with the invention having directors 4 that are arranged tightly adjacent to one another—as segments along the cylinder jacket—said directors 4 being arranged in ring form around the satellite reception antenna 2. The mutually adjacent conductor ends 11 of the elongated horizontal conductors 5 are capacitively coupled to one another. The directors 4 are, as in FIG. 8, cut out as strips 9 of sheet metal from the sheet metal surface of the ground plate 3*a* and are bent by the bend angle 10 of 90°. The conductor ends 11 of the elongated electrical conductors 5 are shaped in angular form and are bent radially outwardly with respect to the center Z in a manner such that a respective sheet metal lug 12 is formed and the capacitive coupling is effected by the lug surfaces standing in parallel with one another of the respective mutually adjacent directors 4;

FIG. 13:

an antenna arrangement 1 in accordance with the invention as in FIG. 12, but with the difference that, to reduce the space requirements, the sheet metal lugs 12 are radially inwardly bent—with respect to the center Z—to form the capacitive coupling;

FIGS. 14A and 14B:

FIG. 14A, a design of the directors 4 surrounding the satellite reception antenna 2, as in FIG. 13, but as a sheet metal ring 25 cut and shaped coherently from a metal sheet. The connection webs 26 at the lower ends of the vertical conductors 6 created in this process form the ground points 8 by placing the sheet metal ring 25 on the ground plate 3*a* and with their electrical connection; the vertical arrows describe the direction in which the sheet metal ring 25 is placed onto the ground plate 3*a*. The satellite antenna 2 is not shown in this Figure;

FIG. 14B, a representation of the antenna arrangement 1 in accordance with the invention with a sheet metal ring 25 placed on the ground plate 3*a* and electrically conductively connected thereto at the ground points 8 as under a) with the satellite reception antenna 2 at the center, for example at the construction space Br2. The further satellite reception antenna 23 is, as in FIGS. 10 and 11, attached to the construction space 6.

The invention starts from a circularly polarized satellite reception antenna 2 which is located above an electrically conductive base surface 3 and whose relative antenna height $ha/\lambda$ with respect to the free space wavelength $\lambda$ is smaller than 0.15. The problematic property is associated with this extremely small height ha of the antenna that its radiation gain drops very fast toward smaller angles of elevation. This is likewise associated with an amplified reduction in the cross-polarization spacing. This effect can be alleviated so much by the presence of the directors 4 that a satellite reception antenna 2 having the predefined construction volume on the electrically conductive outer skin of a vehicle 7 can also be used for qualified location determination with the aid of the satellite navigation. In this respect, satellite reception signals have to be evaluated for the navigation that are incident at the small angle of elevation of 20° down to an angle of elevation of 5°. The extremely strong drop of the antenna gain at such small angles of elevation for the desired polarization direction of such a small satellite reception antenna 2 above a conductive base surface 3 is based on the weakness of the horizontal component of its electrical radiation field. This weakness is alleviated in accordance with the invention by the use of the directors 4 about the satellite reception antenna 2 and the raising of the antenna gain for small angles of elevation succeeds.

The directors form, with respect to the base surface, an arch or a (U-shaped) gate (cf. FIG. 1A) that comprises the vertical conductor 5 and the two vertical conductors 6.

Figure 2:
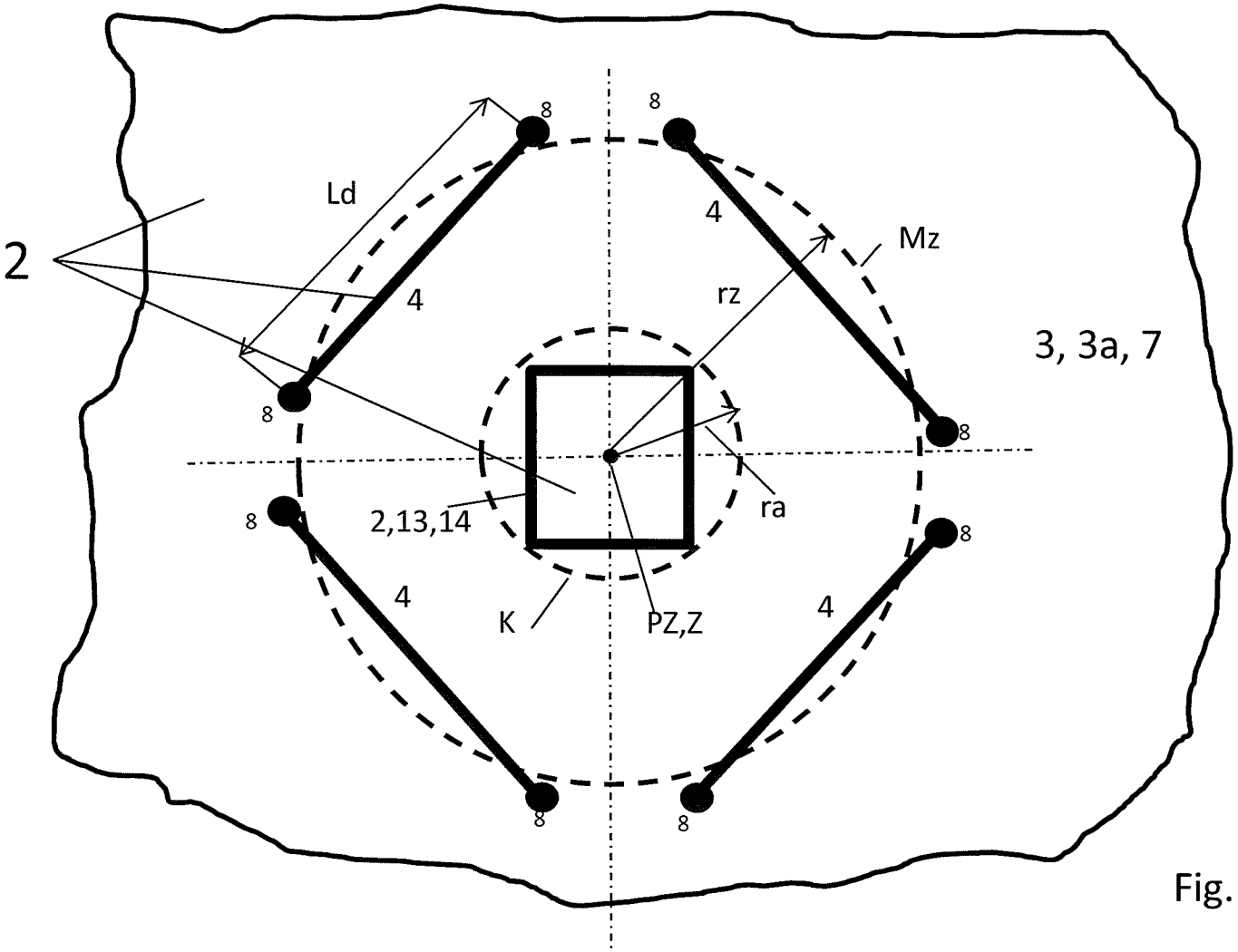

A plausibility observation can explain the mode of operation of the directors 4 in an approximated manner with reference to the spatial representation of the antenna arrangement 1 in accordance with the invention in FIG. 1A and its plan view in FIGS. 1B and 2. In this respect, the azimuthally almost complete surrounding of the satellite reception antenna 2 by directors 4 results in the desired raising of the antenna gain with omnidirectionality. The satellite reception antenna 2 configured for circular polarization excites the electrical conductors of the directors 4 with the currents flowing on it. The conductor ends 11 of the horizontal electrical conductor 5 are each connected via the vertical conductors 6 at a ground point 8 to the conductive base surface 3. Secondary currents are thus formed on the electrically excited director 4 and in particular also on the horizontal electrical conductor 5 that generate a radiation field on a suitable choice of the director length in the range $0.2<Ld/\lambda<0.45$, of the director height in the range $0.03<hd/\lambda<0.15$, and of the cylinder radius in the range $0.15<rz/\lambda<0.5$ that determines the spacing of the directors 4 from the center Z of the antenna arrangement. Said radiation field is superposed on the radiation field of the satellite reception antenna 2 in a manner such that the desired raising of the antenna gain is in particular adopted for small angles of elevation. A director length Ld that is shorter than half a free space wavelength $\lambda$ is particularly effective, that is the natural resonant frequency of the director 4 is selected a little smaller than the satellite reception frequency f. The difference, that is selected as small, of the satellite frequency f from the natural resonant frequency of the director 4 establishes the increase associated therewith of the currents on the director 4 and, in combination with the suitably set cylinder radius rz, the constructive superposition of the director radiation field resulting therefrom with respect to the phasing with the radiation field of the satellite reception antenna 2 in the sense of the object to be satisfied. The horizontal electrically conductive conductors 5 above the electrically conductive base surface 3 below the director height hd each form an electrical line ended at both conductor ends 11 via the vertical conductors 6 with the wave resistance ZL whose amount is given by the conductor width 26 or by the width 21 of the sheet metal strip and by the conductor spacing 28 of the horizontal electrical conductor 5 from the conductive base surface 3. On a design of a director 4, for example, from wire, the wave resistance ZL can be varied in wide limits by setting the ongoing capacitance and the ongoing inductance of the horizontal electrical conductor 5, e.g. with the aid of a meandering shifting. A fine adjustment of the spacing rz of the director 4 from the center Z and the selection of a suitable wave resistance ZL as well as the natural inductance of the vertical conductors 6 enables the optimization of the radiation pattern of the antenna arrangement 1 in the sense of the object of the invention.

Measurement results in the form of vertical and horizontal sections of radiation patterns of antenna arrangements 1 in accordance with the invention are shown by way of example in FIGS. 3A to 7B and are compared with corresponding measurement results of a satellite antenna 2 above a conductive base surface 3 without directors 4 in accordance with the invention. The achieved improvements in the region of small angles of elevation are indicated in detail in connection with the above descriptions of the Figures.

Figure 8:
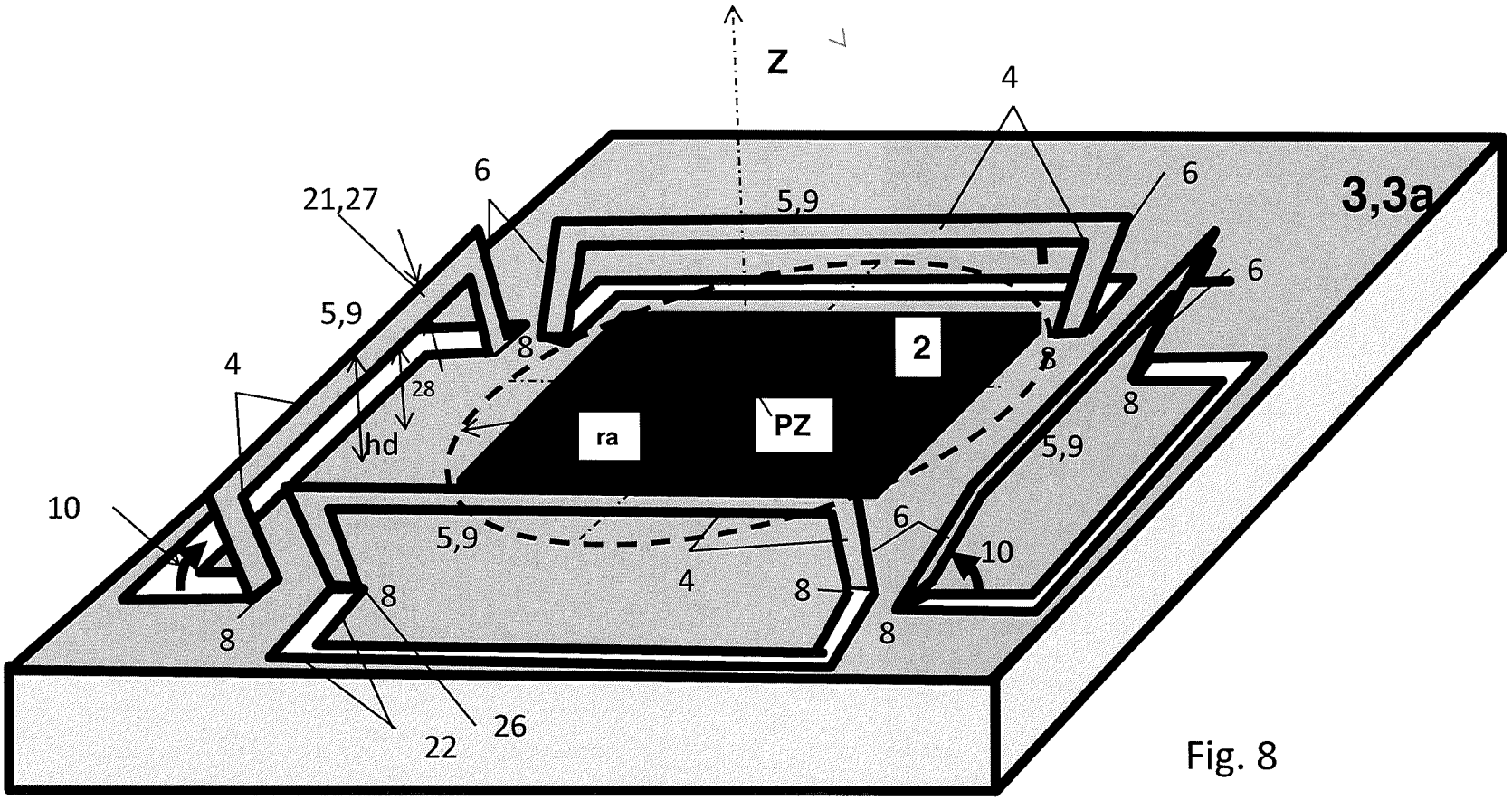

The manufacturing costs and the simple implementation capability are essential for the use in automotive construction. In an advantageous embodiment of the invention, as shown in FIG. 8, the ground plate 3*a* lying on the outer skin of the vehicle 7 is designed as a mechanical carrier of the satellite reception antenna 2 and of the directors 4 and is produced from sheet metal. The possibility results as a special advantage here in accordance with the invention of cutting the directors 4 out of the sheet metal and of bending them out thereof by the bend angle 10. The cutting and bending processes required for this purpose can be carried out extremely inexpensively in mass production with very good reproducibility.

From a technical vehicle aspect, construction spaces—Br1-Br6 in FIG. 9—in the marginal zones on the vehicle roof are primarily available for the attachment of a satellite reception antenna 2. A significant impairment of the azimuthal directional pattern and of the cross-polarization results as a consequence of the already mentioned azimuthally irregular environment. A shift of the phase center PZ of the antenna arrangement 1 that degrades the navigation result equally results in dependence on the spatial angle of the incident satellite reception signals.

The irregular change of the horizontal directionality can in particular already be counteracted by a targeted director 4 placement at angles of elevation around 20°. This measure in accordance with the invention is particularly helpful on the selection of construction spaces Br1, Br2, and Br6 preferred from a technical vehicle aspect on the vehicle roof 16 in which due to the abrupt interruption of the conductive base surface 3 at the rear roof edge 18 at the upper margin of the rear window pane 15 and due to the curvature of the vehicle roof 16 that is frequently present there, the radiation characteristics of a satellite reception antenna 2 are highly impaired as a rule.

As the number of satellite radio services for satellite navigation and satellite radio increases, the construction spaces are placed more closely and the radiation characteristics are impaired by electromagnetic coupling. In the example already described above in FIG. 10, the satellite reception antenna 2 for GNSS is attached in an arrangement in accordance with the invention with two mutually oppositely disposed directors 4 to the construction space Br2 and the satellite reception antenna 23 for the radio reception at approximately 2.3 GHz is attached to the construction space Br6. Both antennas are designed as loop antennas 13 in the example. It is shown very advantageously here that the strict demands on the radiation characteristics of the satellite radio reception antenna 23 are not impaired by the presence of the directors 4 in accordance with the invention. Due to the large spacing between the natural resonant frequencies of the directors 4 and the frequency of the satellite radio, the secondary currents that the satellite radio antenna 23 causes on the directors 4 are sufficiently small that their effect on the radiation characteristics of the satellite radio antenna 23 can be neglected. This effect is pronounced in a manner such that the disruption of the radiation properties of the satellite radio antenna 23 is FIG. 11 is even small when the satellite reception antenna 2 for GNSS is completely surrounded by directors 4.

Figure 11:
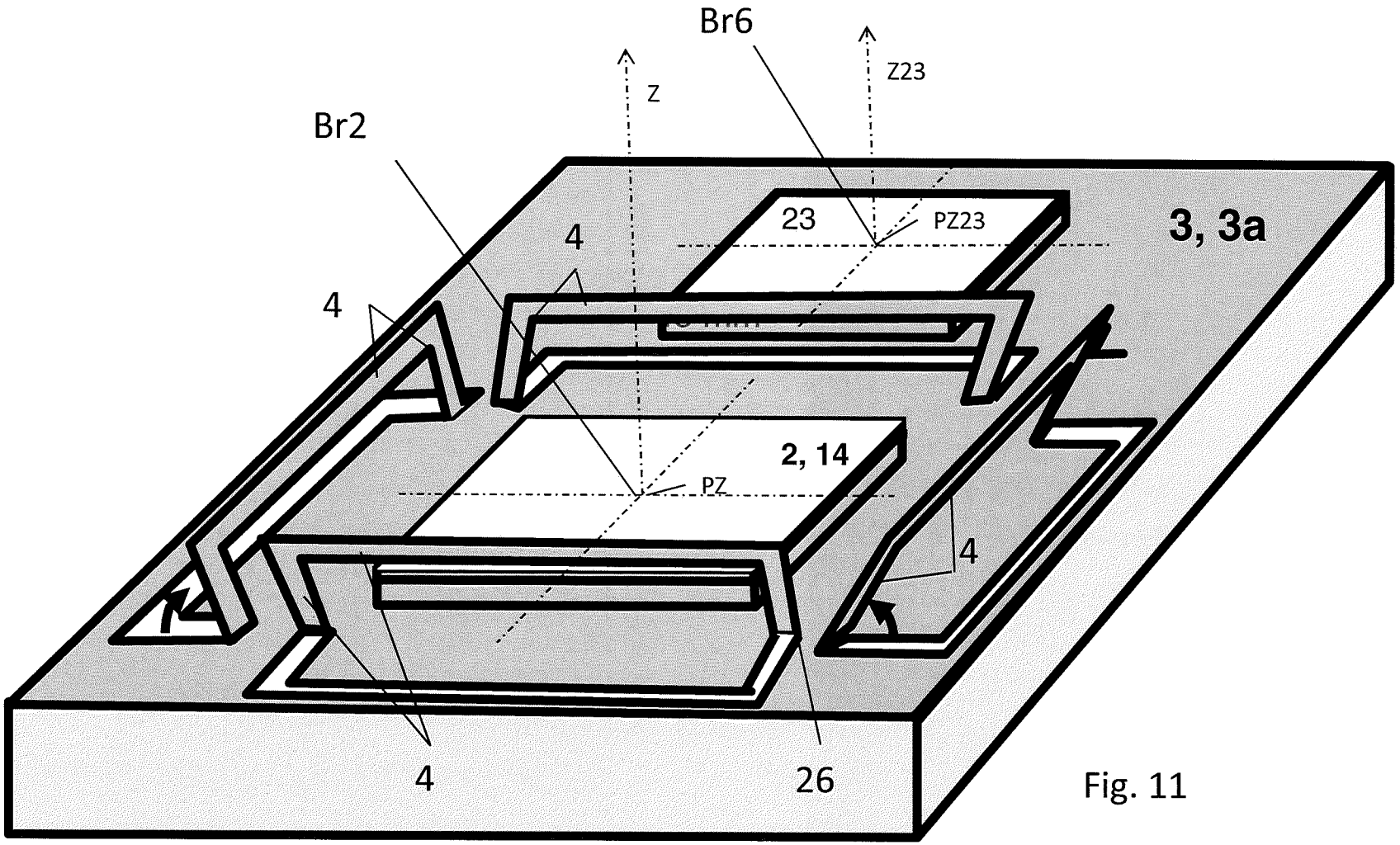

In a similar manner as in FIG. 11, the satellite reception antenna 2 in FIG. 12 is completely surrounded by directors 4 that, however—more than in FIG. 11 in a further advantageous embodiment of the invention—are arranged in close order after one another, that is in a close spacing along the cylinder jacket ZM. The mutually adjacent conductor ends 11 of the elongated horizontal electrical conductors 5 are capacitively coupled to one another. A further improvement of the cross-polarization spacing and of the azimuthal independence of the phase center at small angles of elevation is achieved with this coupling. It results from an additional configuration with secondary currents on the horizontal electrical conductors 5 that are adopted from the capacitive bypassing of the voltage differences between the adjacent conductor ends 11 that form via the vertical electrical conductors 6. The phases of the currents on the satellite reception antenna 2 that vary with the azimuthal angle effect the excitation of secondary currents having different phases in the different directors 4. These secondary currents generate different voltages on the inductive effects of the mutually adjacent vertical electrical conductors 6 and the difference of these voltages causes the desired effect of the improvement of the cross-polarization spacing via the capacitive coupling.

As described in connection with FIG. 11, the directors 4 are cut out of the sheet metal-shaped ground plate 3*a* with the exception of the short connection webs 26 and are bent out of the sheet metal-shaped ground plate 3*a* along the bend line 24, with the bend angle 10 being selected at 90°. To intensify the capacitive coupling, the conductor ends 11 of the elongated electrical conductor 5 are formed areally and in angular form in a manner such that a respective sheet metal lug 12 is formed. The sheet metal lugs 12 are outwardly radially bent—with respect to the center Z—in a manner such that the areas between two adjacent sheet metal lugs 12 are aligned substantially in parallel with one another and the increased capacitive coupling is thus achieved. Even though the shown implementation of an antenna arrangement 1 in accordance with the invention apparently appears complicated, it can nevertheless be manufactured extremely inexpensively by stamping and bending techniques in mass production. To reduce the transverse extent of the antenna arrangement 1, the sheet metal lugs 12 shown in FIG. 12 can be radially inwardly bent—with respect to the center Z—as can be seen from FIG. 13.

In a further advantageous embodiment of the invention, the directors in FIG. 14A are assembled contiguously in ring form to form a mechanically coherent ring of sheet metal. They are connected to one another via short connection webs 26. Provision is made to place the ring manufactured from sheet metal onto the ground plate 3*a*—as the vertical arrows indicate—and to connect the connection webs 26 electrically conductively to the ground points 8 located on the ground surface 3 as can be seen from FIG. 14B.

REFERENCE NUMERAL LIST

1 antenna arrangement
2 satellite reception antenna
3 electrically conductive base surface
3*a* ground plate
4 director
5 horizontal electrical conductor
6 vertical conductor
7 outer skin of a vehicle
8 ground points
9 sheet metal strip
10 bend angle
11 conductor ends
12 sheet metal lug
13 loop antenna
14 patch antenna
15 rear window pane
16 vehicle roof
17 lateral roof edge
18 rear roof edge
18*a* front roof edge
19 rear cover
20 front cover
21 sheet metal strip width
22 section lines
23 further satellite reception antenna
24 bend line
25 sheet metal ring
26 connection webs
27 conductor width
28 conductor spacing
λ free space wavelength
ha antenna height
PZ phase center
ra antenna radius
rz cylinder radius
Z central axis
Ld director length
hd director height
K circle
Mz cylinder jacket
Br1-Br7 construction space
ZL wave resistance

The invention claimed is:

1. An antenna arrangement for the reception of circularly polarized satellite radio signals having a free space wavelength λ and a frequency f, the antenna arrangement comprising at least one circularly polarized satellite reception antenna positioned above an electrically conductive base surface, with a. relative antenna height $ha/\lambda<0.15$ whose outline is inscribed by a circle K about its phase center PZ having a relative antenna radius $ra/\lambda<0.15$, the antenna arrangement further comprising the following features:

a director that comprises a horizontal electrical conductor that has two conductor ends and that is guided over a director length Ld at a director height hd above the conductive base surface, and indeed at least approximated to a jacket surface Mz of a cylinder oriented perpendicular to the conductive base surface and having a cylinder radius rz and a central axis Z through the phase center PZ of the satellite reception antenna, wherein the horizontal electrical conductor is angled at its two conductor ends and extends from there as vertical conductor in each case toward the conductive base surface and is electrically conductively connected thereto; the director being adapted by designing the director length Ld, the director height hd, and the vertical conductor in a manner such that. its natural resonant frequency is set in frequency proximity to the frequency f.

2. The antenna arrangement in accordance with claim 1, wherein said at least one circularly polarized satellite reception antenna is for satellite navigation.

3. The antenna arrangement m accordance with claim 1, wherein the director length is selected in the range $0.2<Ld/\lambda<0.45$;

the relative director height is selected in the range $0.03<hd/\lambda<0.15$; and the cylinder radius is selected in the range $0.15<rz/\lambda<0.5$.

4. The antenna arrangement in accordance with claim 1, wherein the horizontal electrical conductor is designed in a straight line.

5. The antenna arrangement in accordance with claim 4 wherein the two vertical conductors are arranged in the region of the jacket surface Mz.

6. The antenna arrangement in accordance with claim 1, wherein the director length is selected as shorter than approximately 90% of half the free space wavelength λ and the cylinder radius rz is selected as approximately 20% of the free space wavelength λ.

7. The antenna arrangement in accordance with claim 1, wherein, in order to reduce the cross-polarization at small angles of elevation over the total azimuth angle range, at least three directors are arranged azimuthally uniformly about the satellite reception antenna.

8. The antenna arrangement in accordance with claim 7, wherein the cylinder radius rz is selected as not larger than half a free space wavelength.

9. The antenna arrangement in accordance with claim 1, wherein, in order to compensate an impairment of the azimuthal directional pattern and of the cross-polarization spacing, caused by an azimuthally sectorally irregular environment, the at least one director is positioned at a spacing of no more than half a free space frequency wavelength λ remote from the phase center PZ for a direct irregular change of the horizontal directionality.

10. The antenna arrangement in accordance with claim 9, wherein the azimuthally sectorally irregular environment comprises angles of elevation around 30° .

11. The antenna arrangement in accordance with claim 1, wherein an electrically conductive ground plate is present as a mechanical carrier of the satellite reception antenna and of the at least one director on which ground points are formed for an electrically active connection of the director.

12. The antenna arrangement in accordance with claim 11, wherein the ground plate is designed at least in part from an electrically conductive sheet metal surface; and wherein the director is cut out of this sheet metal surface except for a connection web as a ground point and is bent out of the sheet metal surface by a bend angle.

13. The antenna arrangement in accordance with claim 1, wherein the director is configured in wire form.

14. The antenna arrangement in accordance with claim 1, wherein for the azimuthally sectoral raising of the antenna gain for small angles of elevation at least two directors are arranged closely adjacent to one another along the cylinder jacket Mz; and wherein the mutually adjacent conductor ends of the horizontal electrical conductors are capacitively coupled to one another.

15. The antenna arrangement in accordance with claim 1, wherein for the azimuthally independent raising of the antenna gain and for a further improvement of the cross-polarization spacing, the satellite reception antenna is completely surrounded in an azimuthally symmetrical form by mutually adjacent directors that are capacitively coupled to one another with respect to their conductor ends.

16. The antenna arrangement in accordance with claim 1, wherein a plurality of directors are provided that comprise electrically conductive sheet metal and are respectively shaped and bent angled form at the conductor ends of the elongated electrical conductor in a manner such that. a respective sheet metal lug is formed, with a capacitive coupling being effected by lug surfaces of the respective mutually adjacent directors in parallel with one another.

17. The antenna arrangement in accordance with claim 16, wherein the directors are arranged in ring form are combined in a contiguous manner to form a mechanically coherent ring of sheet metal, with the connection of the directors being given by connection webs that are placed on a ground plate and are connected to it electrically conductively at ground points.

18. The antenna arrangement in accordance with claim 1, wherein the satellite reception antenna is a circularly polarized loop antenna having a relative height $ha/\lambda \sim 0.1$ and its vertical projection is inscribed by a circle having the relative antenna radius $ra/\lambda \sim 0.13$ nm about its phase center PZ; and the director length $Ld/\lambda \sim 0.3$ is selected;

the director height $hd/\lambda \sim 0.07$ is selected; and the cylinder radius $rz/\lambda \sim 0.2$ is selected.

19. The antenna arrangement in accordance with claim 1, wherein the satellite reception antenna is formed as a circularly polarized patch antenna.

* * * * *